US005182486A

United States Patent [19]

Itoh et al.

[11] Patent Number: 5,182,486

[45] Date of Patent: Jan. 26, 1993

[54] CERAMIC ELECTRIC-DISCHARGE LAMP INCORPORATING ARC TUBE HAVING AT LEAST TWO CURVED REGIONS

[75] Inventors: Akira Itoh; Kazuyoshi Okamura, both of Yokohama; Kazuiki Uchida, Fujisawa, all of Japan

[73] Assignee: Toshiba Lighting & Technology Corporation, Tokyo, Japan

[21] Appl. No.: 574,775

[22] Filed: Aug. 30, 1990

[30] Foreign Application Priority Data

Aug. 31, 1989 [JP] Japan ..... 1-223303
Sep. 12, 1989 [JP] Japan ..... 1-234654

[51] Int. Cl.[5] ..... H01J 61/33; H01J 61/34

[52] U.S. Cl. ..... 313/25; 313/17; 313/573; 313/642; 313/312

[58] Field of Search ..... 313/25, 17, 27, 47, 313/573, 634, 642, 312, 493

[56] References Cited

U.S. PATENT DOCUMENTS 2,228,327 1/1941 Spanner ..... 313/25 X
4,481,442 11/1984 Albrecht et al. ..... 313/493
4,977,349 12/1990 Asakura et al. ..... 313/493 X

FOREIGN PATENT DOCUMENTS 0026428 4/1981 European Pat. Off. ..... 313/493
0144647 11/1980 Japan ..... 313/25
58-145054 8/1983 Japan .
0112243 6/1985 Japan .

OTHER PUBLICATIONS

J. H. Ingold and D. M. Rutan, "Around the Bend in the Biaxial Fluorescent Lamp", Journal of the Illuminating Engineering Society, vol. 17, No. 2, pp. 29–38, Jun. 1988.

*Primary Examiner*—Donald J. Yusko
*Assistant Examiner*—Ashok Patel
*Attorney, Agent, or Firm*—Cushman, Darby & Cushman

[57] ABSTRACT

The invention provides a ceramic electric-discharge lamp having a pinch-sealer which is set to an end of an outer envelope and covered by a base having a pair of base pins projecting themselves into the base. The outer envelope is in vacuum, in which an arc tube composed of a square U-shaped tube is installed. Apertures of both ends of the square U-shaped illuminant are closed by ceramic discs each containing an electrode. Linear illuminant is formed in such regions where the radius of curvature of the square U-shaped arc tube greatly varies, in other words, between the curved portions.

8 Claims, 3 Drawing Sheets

CERAMIC ELECTRIC-DISCHARGE LAMP INCORPORATING ARC TUBE HAVING AT LEAST TWO CURVED REGIONS

BACKGROUND OF THE INVENTION

1. Field of the Invention

The present invention relates to a ceramic electric-discharge lamp like a high pressure sodium lamp for example. In particular, the invention relates to a ceramic electric-discharge lamp which is composed a translucent ceramic tube and contains arc tube having at least two curved regions.

2. Description of the Related Art

Generally, any conventional high pressure sodium lamp has such a structure in which a pair of electrodes are airtightly sealed in both terminals of an arc lamp composed of a translucent alumina tube for example. Sodium as luminous material, mercury as buffer-gas material, and actuating rare gas, are respectively sealed in the arc tube. Since the translucent alumina tube is highly resistant against heat and corrosion from sodium, this tube is suited for composing an arc lamp of a conventional translucent aluminum lamp. Nevertheless, unlike conventional glass, translucent alumina tube softens itself in presence of high temperature. Availing of this physical property, conventionally, linear tubes produced by an extrusion molding process are widely used for composing envelopes. Consequently, arc tubes are generally provided with linear formation.

Recently, high pressure metallic vaporized electric discharge lamps are widely available for composing the light source of indoor illumination. Reflecting this demand, materialization of compact lamps is urged. On the other hand, applicability of high pressure sodium lamp to the indoor illumination has been studied among the concerned. To achieve this, contraction of the size of arc tube lamp is one of problems to solve.

Contraction of the length of the envelope makes up an idea for materializing compact arc lamps mentioned above. The shorter the length of the envelope, the shorter the distance between a pair of electrodes disposed near the both terminals of the arc lamp.

Nevertheless, it is necessary for any high pressure sodium lamps to suppress superficial temperature of the arc lamp below the predetermined degree. When contracting the distance between a pair of electrodes, since the tubular-wall load increases itself, the tubular diameter must be expanded. On the other hand, the wider the tubular diameter, the thicker the vaporized sodium layer, and as a result, luminous efficiency is sharply lowered by light-absorptive function of sodium.

If the tubular diameter were expanded in accordance with contracting the distance between electrodes, since the edge-corners of the arc tube are remote from the arc, temperature cannot rise. The corner portions bear the lowest temperature unlike any conventional system. This in turn causes amalgam of sodium to condense itself in the coldest region to interrupt evaporation. As a result, the arc tube cannot generate sufficient pressure for the vaporized sodium, thus eventually resulting in the failure to generate the predetermined lamp voltage.

SUMMARY OF THE INVENTION

The object of the invention is to provide a conventional ceramic electric-discharge lamp which can securely be composed in a compact size without lowering luminous efficiency and temperature in the cold region, where the ceramic electric-discharge lamp reflecting the invention incorporates an arc tube which is at least provided with two curved regions and capable of extending its own service life.

According to an aspect of the invention, there is provided a ceramic electric-discharge lamp comprising an arc tube means which is composed of translucent ceramic envelope internally sealing luminous metal, buffer metal, and actuating rare gas, the arc tube means further sealing a pair of electrodes near both ends of the envelope thereof; a base member which is connected to the pair of electrodes sealed inside of the arc tube via wiring means, the base member being subject to connecting with an external power source; wherein the arc tube means has at least two linear and curved portions, where the radius of curvature of the curved portions varies against the linear portions, and wherein any two adjacent ones of the at least two curved portions define a substantially illuminant therebetween.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Referring now more particularly to the accompanying drawings, embodiments of the invention are described below.

Figure 1:
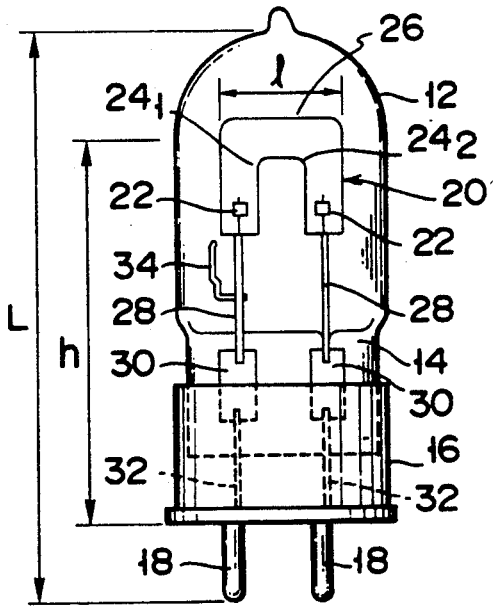
FIG. 1 is a structure of the first embodiment of the high pressure sodium lamp related to the invention.

FIG. 1 illustrates a high pressure sodium lamp incorporating 70 W of input capacity, for example. The reference numeral 12 designates an outer envelope composed of quartz glass. A pinch-sealer 14 is secured to an end of the outer envelope 12. The pinch-sealer 14 is covered with a base 16 made from ceramics. A pair of base pins 18 project themselves from the base 16. The external envelope 12 has about 25 mm of external diameter. There is about 85 mm of the length "L" between the tip of these base pins 18 and the tip of the outer envelope 12.

The interior of the outer envelope 12 remains in vacuum, in which an arc tube 20 is installed. The arc tube 20 is composed of a translucent alumina tube. Alumina is formed into square U-shaped for composing tube by applying a precipitation method. Apertures on both sides of the square U-shaped arc tube 20 are closed by means of ceramic discs (not shown). These ceramic discs are respectively provided with an electrode 22 by way of internally sealing it.

The arc tube 20 contains 1.5 mg of sodium Na, 8.5 mg of mercury Hg, and 20 torr of xenon gas Xe, respectively. The arc tube 20 has about 4.5 mm of internal diameter and about 32 mm of the spacing between both electrodes across the center line of the envelope. Linear illuminant 26 is substantially formed between curved portions $24_1$ and $24_2$ at which the radius of curvature of the square U-shaped arc tube 20 greatly varies. The length "l" of the illuminant 26 corresponds to 70 through 80% of the total length of the arc tube 20 like 15 mm for example. In this case, there is about 56 mm of the distance "h" between the illuminant 26 and the bottom of the base 16.

One-ends of a pair of supporting wires 28 (which concurrently serve as lead wires) are respectively connected to those electrodes 22. The other ends of the supporting wires 28 are respectively connected to a pair of metallic foils 30 made from molybdenum sealed in the pinch-sealer 14. These metallic foils 30 are respectively connected to the base pins 18 via external lead wires 32. A pair of getters 34 composed of pulverized Zr-Al or the like are respectively connected to the supporting wires 28.

Both of the sealed ends of the arc tube 20 face crushed sealer edge 14 of the outer envelope 12. The illuminant 26 internally faces the tip of the outer envelope 12.

The high pressure sodium lamp built with the above structure can output about 6,000 lm by applying 70 W of input power for example. This corresponds to the light output of any conventional 70 W of input capacity high pressure sodium lamp.

Nevertheless, the high pressure sodium lamp reflecting an embodiment of the invention features the very short length of the outer envelope 12, which is almost one-half the conventional tube having about 150 mm of the length. In other words, the high pressure sodium lamp reflecting an embodiment of the invention has sharply contracted the total dimensions and achieved compact structure. As a result, it can conveniently be introduced to any compact apparatus.

The high pressure sodium lamp embodied by the invention causes majority of light to be emitted from the linear illuminant 26 which is substantially formed between two curved portions $24_1$ and $24_2$ of the arc tube 20. Since the illuminant 26 extends itself in the direction orthogonally intersecting the axial direction of the outer envelope 12, emitted light can effectively be utilized when the tip of the envelope illuminates the target surface. In consequence, light is distributed in the same way as in the case of disposing filaments of an incandescent lamp in the direction orthogonally intersecting the axial line of the envelope. As a result, in particular, the incandescent lamp of this type is interchangeable with a halogen lamp. Any conventional high pressure sodium lamp disposes the axial direction of the arc tube in the direction identical to the axial line of the outer envelope. Taking this into consideration, unlike any conventional high pressure sodium lamp, the high pressure sodium lamp embodied by the invention is ideally suited for interchanging with an incandescent lamp.

Furthermore, if the square U-shaped arc tube mentioned above were operated, both ends of the arc tube 20 are not only subject to thermal conduction from the illuminant 26 in the center, but these ends are also exposed to radiant heat. As a result, temperature at both ends of the arc tube 20 rises, and yet, because of narrow diameter of the arc tube 20, temperature in the coldest region cannot be raised. This in turn causes the evaporated pressure of sodium amalgam and the lamp voltage to also rise, respectively.

In other words, although the high pressure sodium lamp is perfectly made up, the luminous efficiency is well comparable to that of any conventional large-size high pressure sodium lamp available today.

Furthermore, according to the high pressure sodium lamp embodied by the invention, since there is neither light-shielding member like the one supporting the arc tube 20 nor electrodes on the tip of the envelope, the high pressure sodium lamp of the invention can emit a even greater amount of light.

The above embodiment has solely referred to the case of manufacturing a 70 W of input capacity high pressure sodium lamp. Next, another embodiment for the manufacture of a 100 W of input capacity high pressure sodium lamp is described below.

In this embodiment, the arc tube 20 has about 6.0 mm of internal diameter and about 20 mm of interval between both electrodes passing through the center line of the envelope. The arc tube 20 contains 2.5 mg of sodium Na, 7.5 mg of mercury Hg, and 20 torr of xenon gas Xe, respectively.

Even if the diameter of the envelope of the arc tube 20 were expanded, both ends of the arc tube 20 are still subject to thermal conduction and radiant heat from the illuminant 26 in the center. This in turn causes temperature to rise on both ends of the arc tube 20 and also in the coldest region. As a result, vaporized pressure of sodium amalgam rises to promote the luminous efficiency.

Although the above embodiment has solely referred to the case of manufacturing the arc tube 20 in a square U-shape, the scope of the invention is not merely confined to the production of the square U-shaped arc tube 20.

Figure 2:
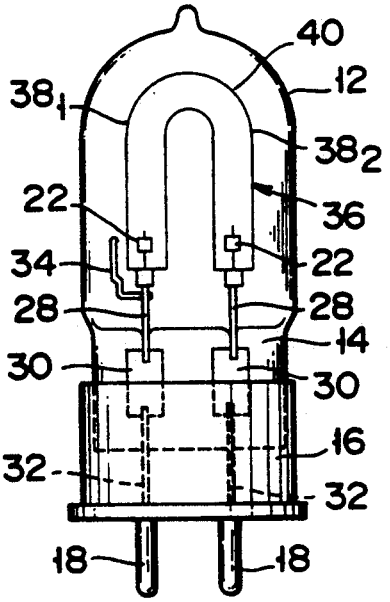
FIG. 2 is a structure of the second embodiment of the high pressure sodium lamp related to the invention.

FIG. 2 illustrates the second embodiment of the high pressure sodium lamp related to the invention. An arc tube 36 shown in FIG. 2 is formed into U-shape. The U-shaped curve between peripheral points $38_1$ and $38_2$ (at which the radius of curvature of the arc tube 36 greatly varies) which substantially compose an illuminant 40. Other components of the second embodiment are identical to those of the preceding first embodiment, and thus, description of these is deleted.

Even when the arc tube is formed into U-shape, unlike the length of the outer envelope of any conventional high pressure sodium lamp, the high pressure sodium lamp reflecting the second embodiment of the invention sharply contracts the length of the outer envelope, and yet, it can yield satisfactory results identical to that of the first embodiment.

Figure 3:
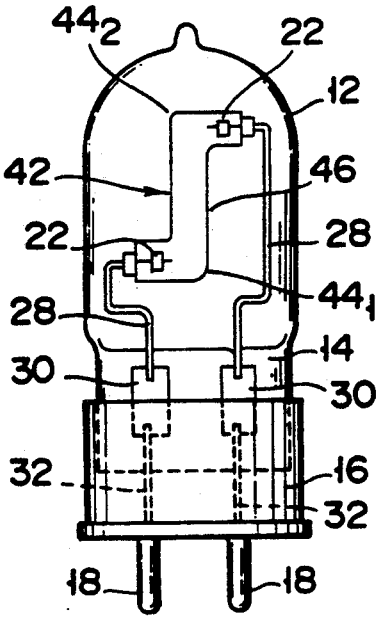
FIG. 3 is a structure of the third embodiment of the high pressure sodium lamp related to the invention.

FIG. 3 illustrates the third embodiment of the invention. Those components shown in FIG. 3 identical to those of the preceding embodiments are designated by the identical reference numerals. Only those component different from those of the preceding embodiments are described below. An arc tube 42 shown in FIG. 3 is formed into square S-shaped. The linear member between curved portions $44_1$ and $44_2$ of the arc tube 42 substantially compose an illuminant 46. The center line of the linear illuminant 46 is disposed on the axia line of the envelope of the outer envelope 12.

When the high pressure sodium lamp incorporating the square S-shaped arc tube 42 remains lit, light is emitted in the direction orthogonally intersecting the axial line of the envelope of the outer envelope 12. In this case, light is distributed in the same way as in the case of an incandescent lamp disposed on the axial line of the envelope. In other words, the high pressure sodium lamp reflecting the third embodiment of the invention is interchangeable with such an incandescent lamp.

Furthermore, unlike any conventional arc tube, the arc tube 42 of the third embodiment can be contracted by the length corresponding to that of the edges of the arc tube 42 itself.

Figure 4:
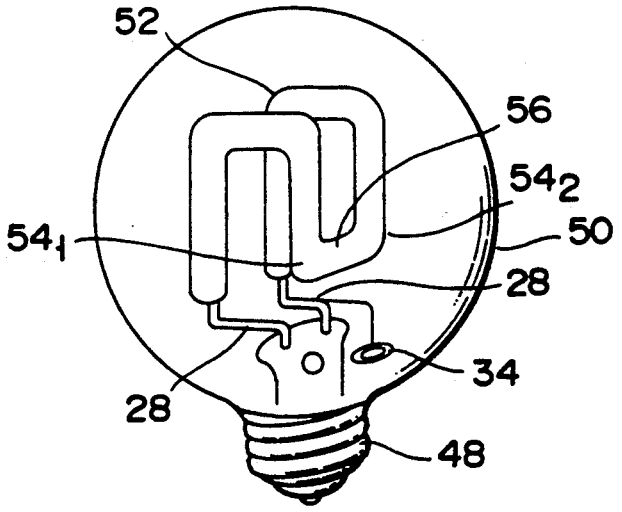
FIG. 4 is a structure of the fourth embodiment of the high pressure sodium lamp related to the invention.

FIG. 4 illustrates the fourth embodiment of the invention. Those components shown in FIG. 4 identical to those of the preceding embodiments are designated by the identical reference numerals. Only those components different from those of the preceding embodiments are described below. The high pressure sodium lamp shown in FIG. 4 has a spherical outer envelope 50 which is provided with a screw-in type base 48. The spherical outer envelope 50 contains ar arc tube 52 formed in saddle-like shape. There are six curves on the saddle-like arc tube 52, of these; the linear member between curved portions $54_1$ and $54_2$ substantially composes as an illuminant 56.

In this case, the axial-directional length of the arc tube 52 against the outer envelope 50 can be contracted into a length shorter than the spacing between a pair of electrodes 22.

As mentioned earlier, according to the invention, since there are more than two of curved portions in the arc tube, even if the interval between the electrodes were identical to that of the conventional system, the length of the illuminant can be contracted, and thus, space can be saved and the size of the outer envelope can also be contracted. Since there is no need of expanding the diameter of the envelope, luminous efficiency and temperature in the coldest region can be prevented from lowering themselves.

Furthermore, since the illuminant can substantially be formed between more than two of the curved regions, light-distribution can easily be designed. Accordingly, the high pressure sodium lamp of the invention is ideally interchangeable with an incandescent lamp by properly designing light-distribution characteristics similar to that of any incandescent lamp like a conventional halogen lamp, for example.

Incidentally, any conventional high pressure sodium lamp having 70 to a maximum of 1,000 W of input capacity containing a conventional linear arc tube uses a translucent alumina tube having 0.5 to 1.0 mm of thickness and operates itself by applying 13 to 20 $W/cm^2$ of the tubular-wall load. If the tubular-wall load were too short, tubular temperature does not sufficiently rise, thus resulting in the poor lamp efficiency. Conversely, if the tubular-wall load were excessive, the tubular temperature excessively rises, thus causing alumina to sublimate itself, and then the outer envelope is blackened, thus expediting to terminate service life.

If curved arc tubes were manufactured for the above high pressure sodium lamps incorporating a curved arc tube according to such a design basis identical to that available for any conventional linear arc tube, light irradiated against the interior of the curve again enters into the inner wall of the curved region and the center of the arc tube, and thus, compared to the case of a linear arc tube, temperature easily rises. As a result, alumina on the inner wall of the curve member may sublimate itself to cause the outer envelope to be blackened.

Next, an example of a further improved high pressure sodium lamp against those of the preceding embodiments is described below. The improved lamp securely prevents alumina from sublimating itself from the inner wall of the curve member and the outer envelope from being blackened even when curved arc tubes are manufactured according to the design basis identical to the one available for any conventional linear arc tubes.

Figure 5:
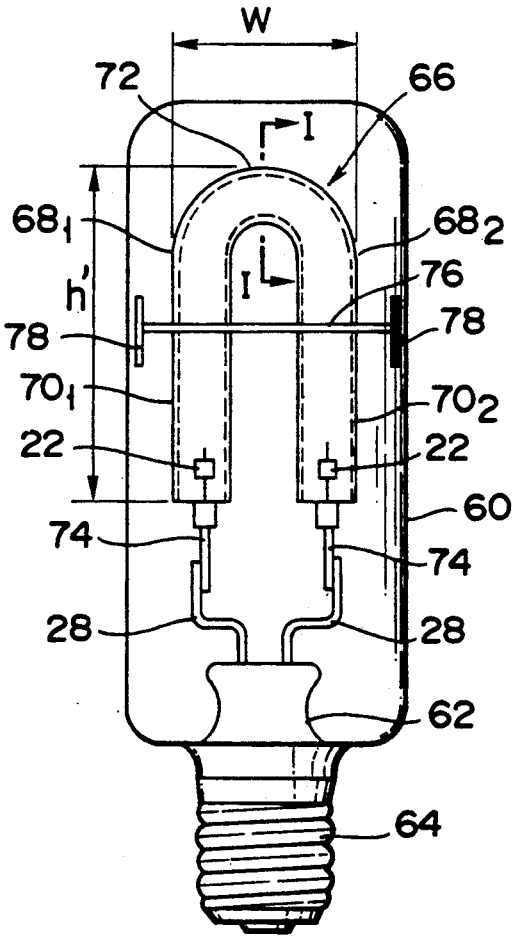
FIG. 5 is a structure of the fifth embodiment of the high pressure sodium lamp related to the invention.

FIG. 5 illustrates the fifth embodiment of the invention related to a high pressure sodium lamp having a 400 W of input capacity. An outer envelope 60 is composed of quartz glass, for example. An end of the outer envelope 60 is sealed by a stem 62, whereas the external surface of this tube 60 is covered by a screw-in type base 64.

The outer envelope 60 remains in vacuum. An arc tube 66 is internally held by the outer envelope 60. The arc tube 66 is composed of translucent alumina tube having U-shape for example. Apertures of both ends of the arc tube 66 are closed by ceramic discs (not shown). Sealed electrodes 22 are internally secured to these ceramic discs.

The arc tube 66 has about 7.25 mm of the internal diameter "d" and about 8.75 mm of mean external diameter "D". There is about 90 mm of interval between those electrodes 22, where the interval orthogonally intersects the center line of the envelope. About 7.5 mm of the curvature passes through the center of the curved portions $68_1$ and $68_2$. The U-shaped arc tube 66 has about 40 mm of height "h".

Figure 6:
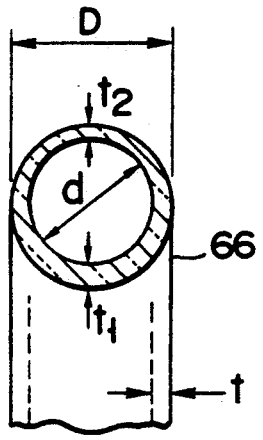
FIG. 6 is a sectional view of the luminous lamp shown in FIG. 5 across the line I—I.

Thickness "t" of the linear portions $70_1$ and $70_2$ of the U-shaped arc tube 66 is almost equivalent to each other in the circumferential direction. In this case, the thickness "t" is 0.75 mm for example. On the other hand, as shown in the sectional view of FIG. 6 across the line I—I shown in FIG. 5, thickness "$t_1$" inside of the curve of the illuminant 72 between the curved portions $68_1$ and $68_2$ is thicker than thickness "$t_2$" outside of the curve. Concretely, in the fifth embodiment, the illuminant 72 has 0.87 mm of the thickness "$t_1$" inside of the curve and 0.65 mm of the thickness "$t_2$" outside of the curve. It is desired that a minimum of 0.5 mm of the thickness "$t_2$" be provided outside of the curve.

A pair of internal lead wires 74 connected to the electrodes 22 are respectively connected to a pair of supporting wires 28. These supporting wires 28 airtightly penetrate stem 62 for connection to the mouthpiece 64.

Linear regions $70_1$ and $70_2$ of the arc tube 66 are mechanically supported by an envelope holder 76. A pair of elastic contact plates 78 like sheet springs are secured to both ends of the envelope holder 76. These elastic contact plates elastically remain in contact with the internal surface of the outer envelope 60 to support the arc tube 66.

The high pressure sodium lamp featuring the above structure is illuminated in order that the tubular-wall load can remain at 19 $W/cm_2$.

As mentioned above, the thickness "$t_1$" inside of the curve of the illuminant 72 between the curved regions $68_1$ and $68_2$ of the U-shape is thicker than the thickness "$t_2$" outside of the curve. As a result, thermal capacitance inside of the curve increases to suppress the rise of the tubular-wall temperature inside of the curve. In consequence, there is no substantial difference of temperature between the outside and the inside of the curve. As a result, there is no need of lowering the tubular-wall load; in other words, there is no need of lowering luminous efficiency, thus preventing alumina from subliming itself.

After completing the production of the high pressure sodium lamp reflecting the fifth embodiment, inventors checked temperature using a radiation pyrometer. Inventors confirmed that 1,160° C. of maximum temperature was present inside of the curve, whereas 1,150° C. of maximum temperature was present outside of the curve, thus providing that there is little difference of temperature between both portions.

Inventors also confirmed that the high pressure sodium lamp of the fifth embodiment generated 125 lm/W of lamp efficiency, thus proving that the result was practically comparable to that of conventional linear arc tubes.

The fifth embodiment has referred to the high pressure sodium lamp having 400 W of input capacity. After testing those high pressure sodium lamps each incorporating an arc tube having 50 through 150 W of input capacity and identical shape, inventors confirmed that satisfactory luminous characteristics could be generated in accordance with those relative conditions shown below, $$0.8\ t \leqq t_2 < t < t_1 \leqq 1.2\ t \quad (1)$$

$$1.1 \leqq t_1/t_2 \leqq 1.5 \quad (2)$$

where "t" designates mean thickness of the arc tube of the illuminant 66 at the linear portions $\mathbf{70_1}$ and $\mathbf{70_2}$; "$t_1$" designates mean thickness inside of the curve of the illuminant 72 between the curved portions $\mathbf{68_1}$ and $\mathbf{68_2}$; and "$t_2$38 designates mean thickness outside of the curve, respectively.

In general, the tubular-wall temperature of a high pressure sodium lamp is preferably set between 1000 to 1150° C. for the sake of both efficiency and service life. When the tubular-wall load is of 13 to 20 w/cm$^2$, value of t is selected so that the tubular-wall temperature falls in the above range. Further, the thinner the thickness thereof becomes, the higher the temperature rises, and vice versa. Therefore, when $t_2 < 0.8$ t, the temperature of the external tubular-wall exceeds 1200° C., and sublimation of alumina is reinforced, thereby expediting termination of service life. Meanwhile, when $t_1 > 1.2$ t, the temperature of the internal tubular-wall does not reach 950° C., thereby deteriorating its efficiency.

Moreover, alumina is likely to be cracked when its temperature gradient exceeds 250 deg/cm, and therefore attention should be paid to the temperature difference between the external and internal tubular-wall. According to our experiments, a tube having the inner diameter of 3.5 to 8 mm is likely to be cracked when $t_1/t_2 > 1.1$ due to the temperature difference, whereas when $t_1/t_2 < 1.5$, condition (2) cannot be satisfied, and therefore, the characteristics of the lamp cannot be made the full use thereof.

When manufacturing the U-shaped arc tube 66 shown in FIG. 5, the relationship between the external diameter "D" of the envelope 60 of the arc tube 66 and the full width "W" of the arc tube 66 should desirably be $2 < W/D < 4$. Furthermore, it is desired that this relationship be in a range of $2.5 < W/D < 3$.

If the value of W/D were less than 2, clearance between the linear portions $\mathbf{70_1}$ and $\mathbf{70_2}$ is too narrow, thus involving much difficulty to properly manufacture the U-shaped arc tube. Conversely, if the value of W/D exceeds 4, the width of the arc tube 66 becomes too wide, and thus, production of compact lamp can hardly be achieved.

The fifth embodiment has solely referred to the formation of the U-shaped arc tube 66. Nevertheless, the invention does not merely confine the scope of the invention to the U-shaped arc tube alone, but as shown in FIG. 1 for example, the invention can also effectively be applied to such an arc tube having a square U-shape, and yet, the invention can also be applied to such an arc tube having other specific shapes shown in FIGS. 3 and 4.

As is clear from the foregoing description, the inside of the curved portion of the arc tube is provided with a thickness thicker than that of the outside of the curved portion. In consequence, thermal capacitance inside of the curved increases, thus lowering temperature of tubular-wall inside of the curve. Accordingly, there is little difference of temperature between the inside and the outside of the curve portion. This securely prevents alumina of ceramic envelope from subliming itself, thus allowing service life of the arc tube to be maintained for a long period of time without lowering the tubular-wall load and the luminous efficiency as well.

Additional advantages and modifications will readily occur to those skilled in the art. Therefore, the invention in its broader aspects is not limited to the specific details, and representative devices, shown and described. Accordingly, various modifications may be made without departing from the spirit or scope of the general inventive concept as defined by the appended claims and their equivalents.

What is claimed is:

1. A ceramic electric-discharge lamp comprising:

an arc tube which is composed of a translucent ceramic envelope internally sealing a luminous metal, a buffer metal, and an actuating rare gas, said arc tube further sealing a pair of electrodes, one each near an end of said envelope thereof;

a base member connected to said pair of electrodes sealed inside said arc tube via wiring means, said base member being adapted for connection to an external power source;

wherein said arc tube has at least two linear portions and curved portions, where a radius of curvature of said curved portions varies against said linear portions, wherein any two adjacent ones of said at least two curved portions define a substantial illuminant therebetween, wherein each of said linear portions comprises a linear wall and each of said curved portions comprises an inner wall and an outer wall and wherein the inner walls are formed to be thicker than the outer walls.

2. An apparatus according to claim 1, wherein the inner walls are thicker than the linear walls, whereas the outer walls are slightly thinner than or equal in thickness to said linear walls.

3. An apparatus according to claim 2, wherein the relationship between means thickness of said linear walls, means thickness of said inner walls, and mean thickness of the outer walls is designated by the expressions $$1.1 \leqq t1/t2 \leqq 1.5$$

$$0.8t \leqq t2 < t < t1 \leqq 1.2t$$

where t is the mean thickness of said linear walls of said arc tube, t1 is the mean thickness of the inner walls, and t2 is the mean thickness of the outer walls.

4. An apparatus according to claim 1, wherein the said arc tube is constructed of a material capable of withstanding a temperature of at least 1000° C. without deformation.

5. A ceramic electric-discharge lamp comprising:

an arc tube composed of a translucent ceramic envelope internally sealing a luminous metal, a buffer metal, and an actuating rare gas, and further sealing a pair of electrodes one each near an end of said envelope;

a base member connected to said pair of electrodes sealed inside said arc tube via wiring means, said base member being adapted for connection to an external power source;

an outer envelope in which said arc tube is internally held and attached to said base member;

wherein said arc tube has at least two linear portions and curved portions, where a radius of curvature of said curved portions varies against said linear portions, wherein any two adjacent ones of said at least two curved portions define a substantial illuminant therebetween, and wherein each of said linear portions comprises a linear wall and each of said illuminants comprises an inner wall and an outer wall.

6. An apparatus according to claim 5, wherein the inner walls are thicker than the outer walls.

7. An apparatus according to claim 6, wherein the inner walls are thicker than said linear walls, whereas the outer walls are slightly thinner or equal in thickness to said linear walls.

8. An apparatus according to claim 7, wherein the relationship between mean thickness of said linear walls, mean thickness of the inner walls, and mean thickness of the outer walls is designated by the expressions $$1.1 \leqq t1/t2 \leqq 1.5$$

$$0.8t \leqq t2 < t < t1 \leqq 1.2t$$

where t is the mean thickness of said linear walls of said arc tube, t1 is the mean thickness of the inner walls, and t2 is the mean thickness of the outer walls.

* * * * *